US005865243A

United States Patent [19]

Kato et al.

[11] Patent Number: 5,865,243

[45] Date of Patent: Feb. 2, 1999

[54] HEAT EXCHANGER

[75] Inventors: Soichi Kato; Takashi Sugita, both of Konan, Japan

[73] Assignee: Zexel Corporation, Tokyo, Japan

[21] Appl. No.: 71,030

[22] Filed: May 4, 1998

[30] Foreign Application Priority Data

May 19, 1997 [JP] Japan ..... 9-144662

[51] Int. Cl.[6] ..... F28D 1/03

[52] U.S. Cl. ..... 165/153; 165/173; 165/177; 165/183; 138/115; 138/117

[58] Field of Search ..... 165/177, 179, 165/183, 178, 173, 153; 29/890.053, 890.043; 138/115, 116, 117

[56] References Cited

U.S. PATENT DOCUMENTS

| | | | |
|---|---|---|---|
| 1,394,311 | 10/1921 | Lang | 165/177 |
| 5,186,250 | 2/1993 | Ouchi et al. | 165/177 |
| 5,409,057 | 4/1995 | Zifferer | 165/177 X |
| 5,689,881 | 11/1997 | Kato | 165/177 X |

FOREIGN PATENT DOCUMENTS

| | | | |
|---|---|---|---|
| 45082 | 2/1993 | Japan | 165/183 |
| 247935 | 7/1926 | United Kingdom | 165/177 |

*Primary Examiner*—Leonard R. Leo
*Attorney, Agent, or Firm*—Wenderoth, Lind & Ponack

[57] ABSTRACT

In a flat tube formed by machining a brazing sheet, ridges 12*a*–12*c* are formed at each of the opposing flat portions 11*a* and 11*b* of the flat tube 4 along the lengthwise direction of the flat tubes so that the ridges contact the inner surfaces of each of the opposite flat portions. The width of the grooves of the ridges 12*a*–12*c* formed at the surfaces of the flat portions is set so that it is at the smallest end portions of the flat tubes 4 to achieve flatness at the end portions of the flat tubes 4. The end portions of the fins 5 are bonded at these flattened portions 15 (areas A) formed at the end portions of the flat tubes 4. Header pipes and the flat tubes are thus brazed in a reliable manner while achieving reinforcement of the end portions of the flat tubes to be inserted into insertion holes formed in the header pipes. Through a structure in which ridges are formed at the end portions of the flat tubes and, at the same time, flatness is assured at the end portions, a good yield of the brazing material is realized at the contact areas of the header pipes and the flat tubes.

8 Claims, 7 Drawing Sheets

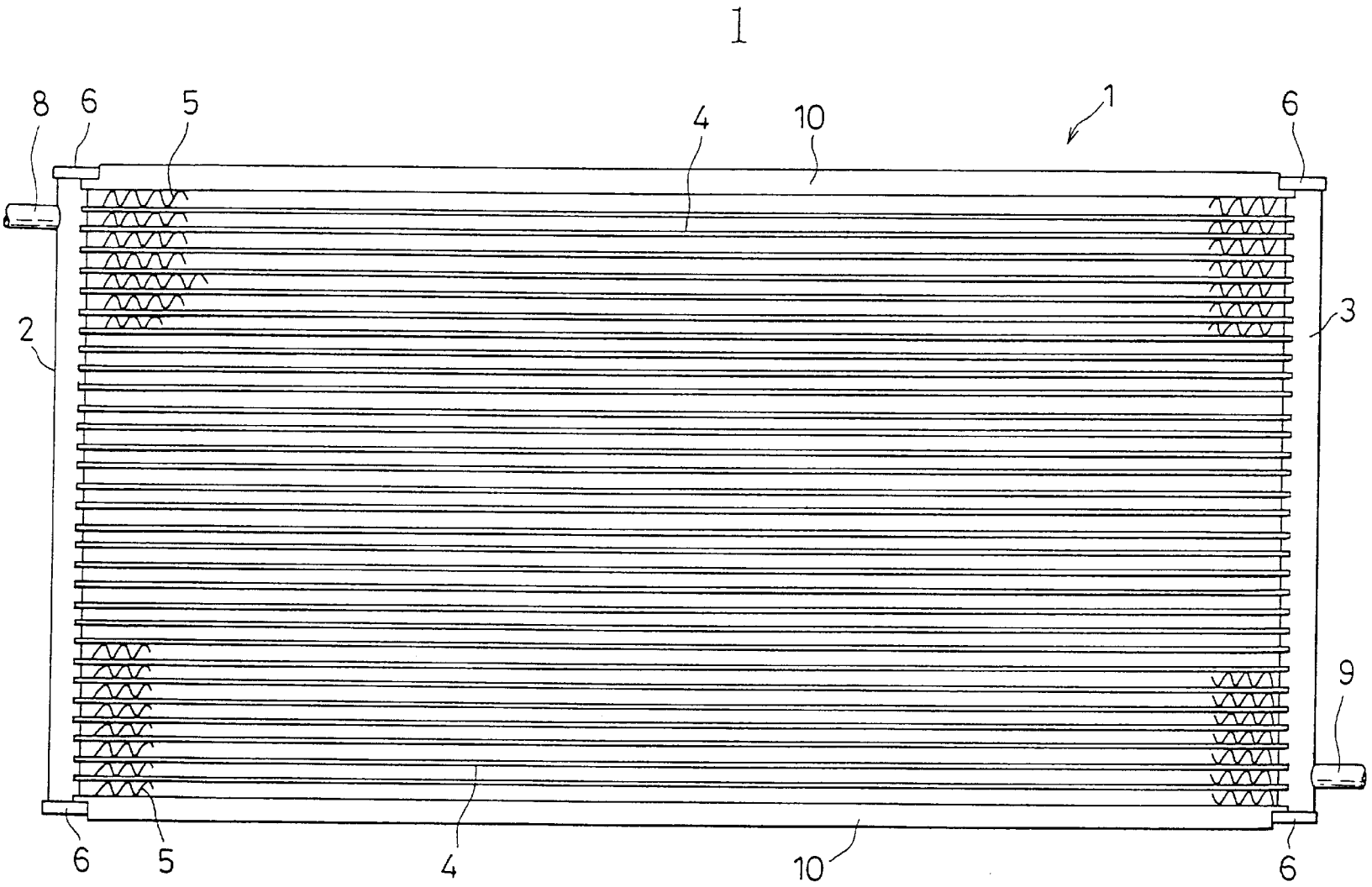
1
2
3
4
4
5
5
6
6
6
6
8
9
10
10

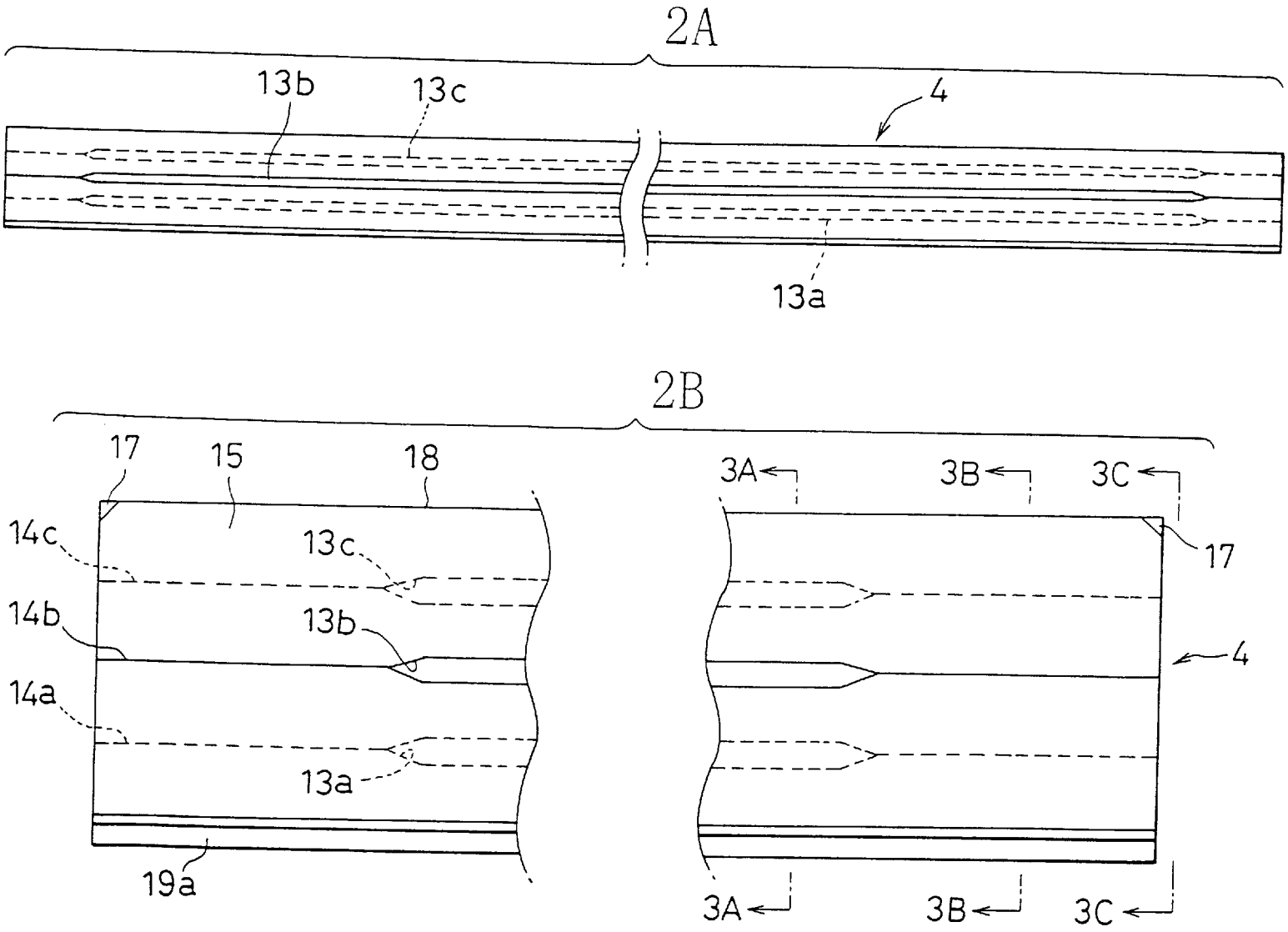
2A
4
13a
13c
13b
2B
4
17
3C
3B
3A
3C
3B
3A
18
13c
13b
13a
15
17
19a
14c
14b
14a 3A
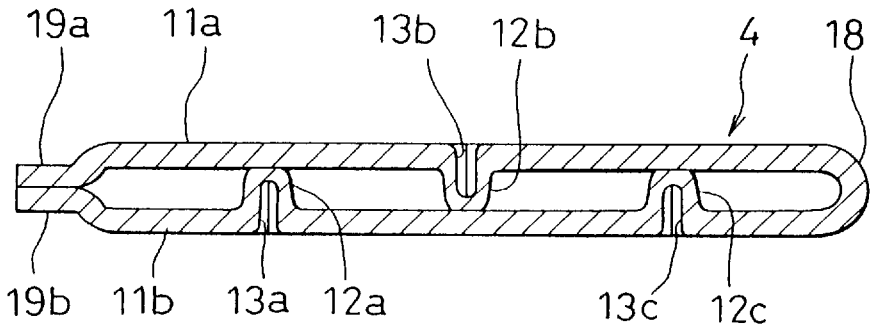
3B
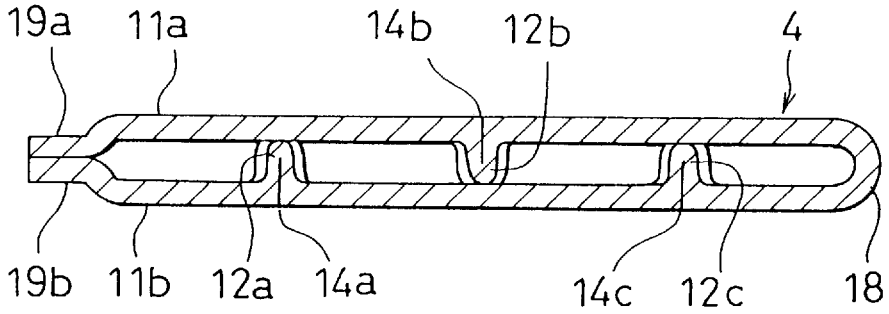
3C
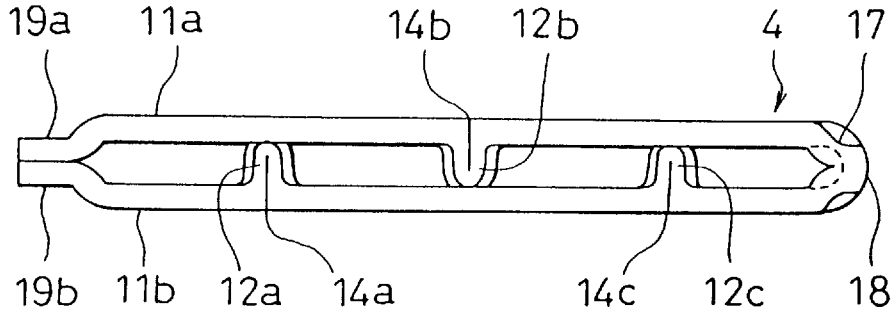

4
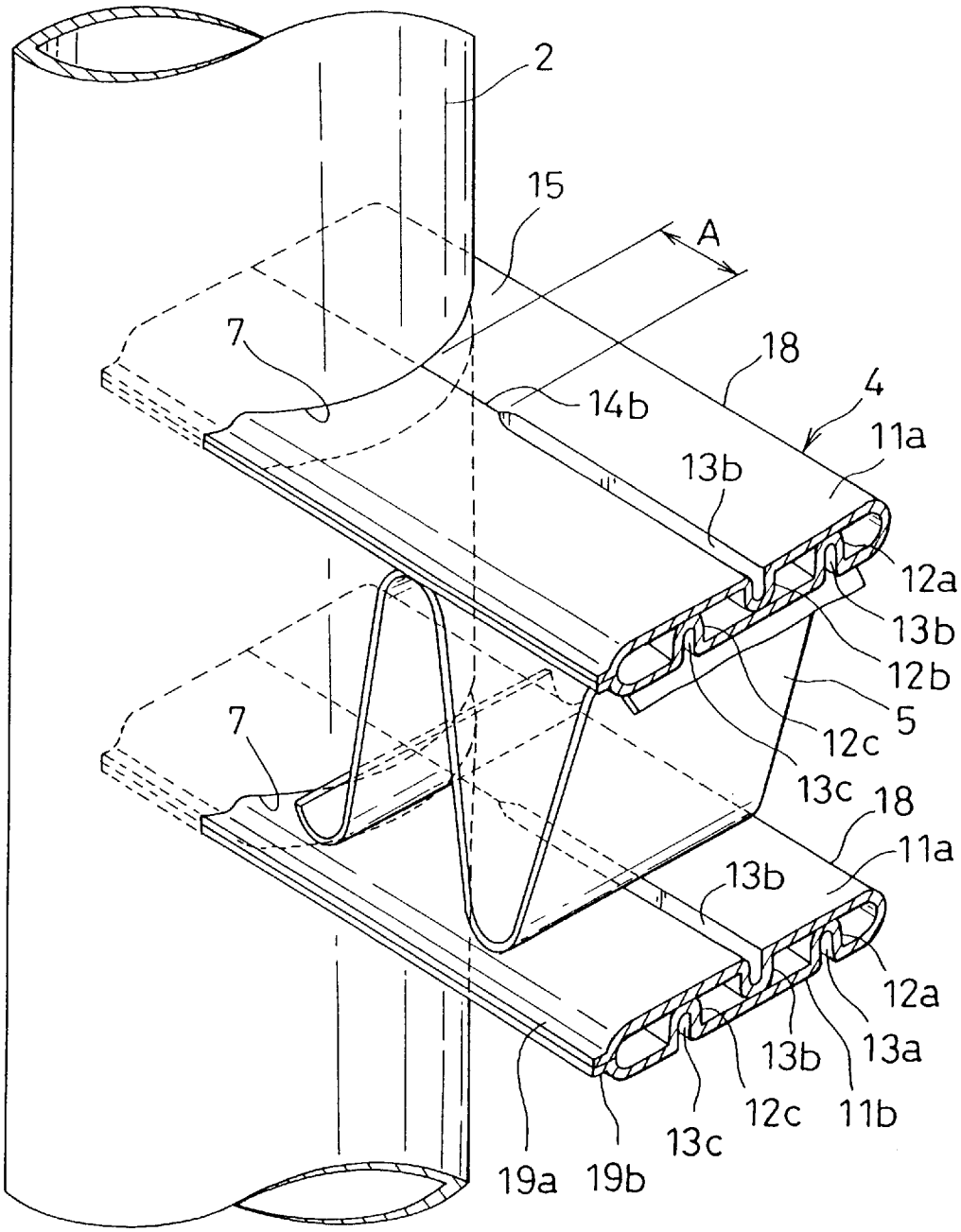

5
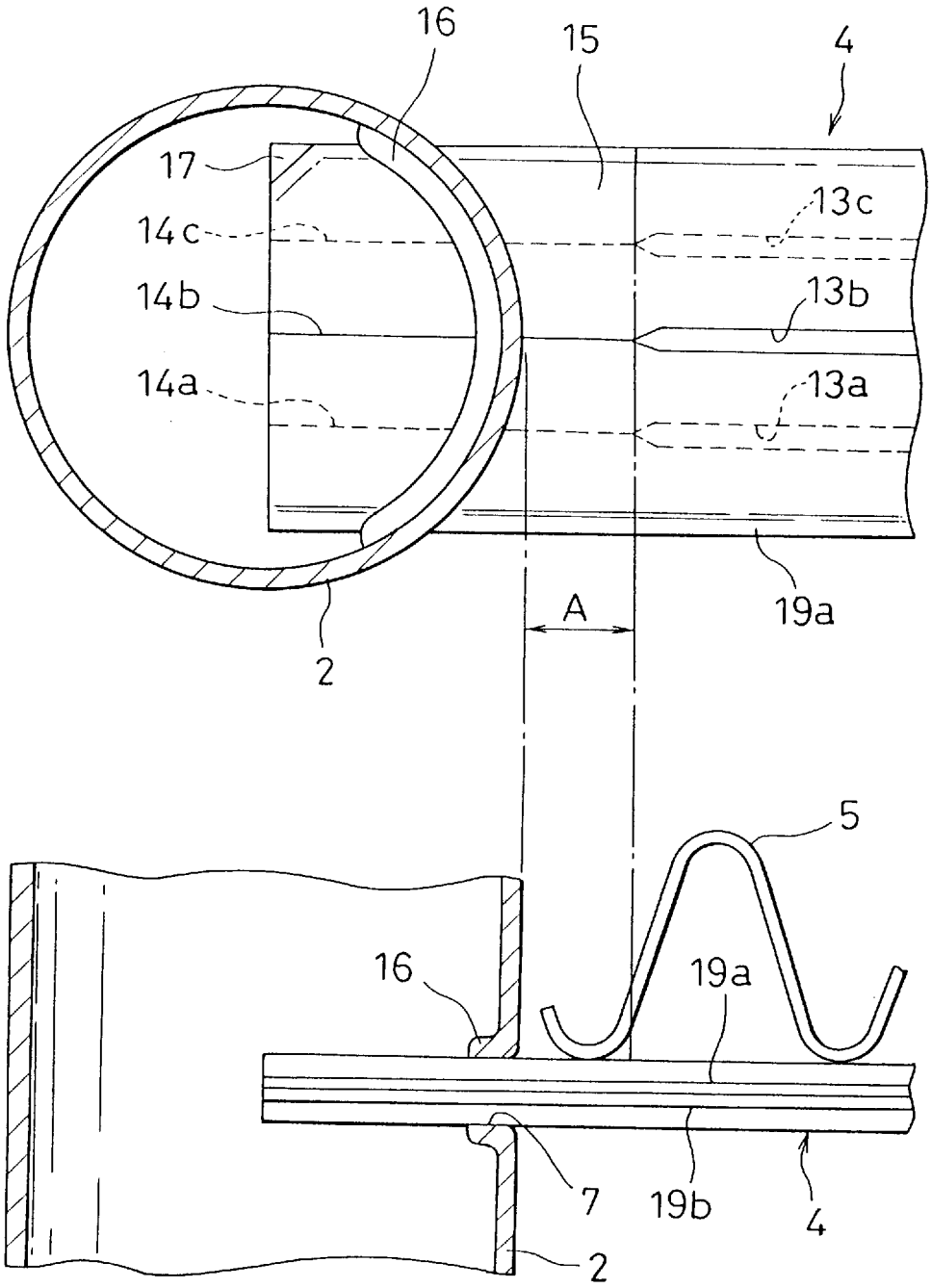

6
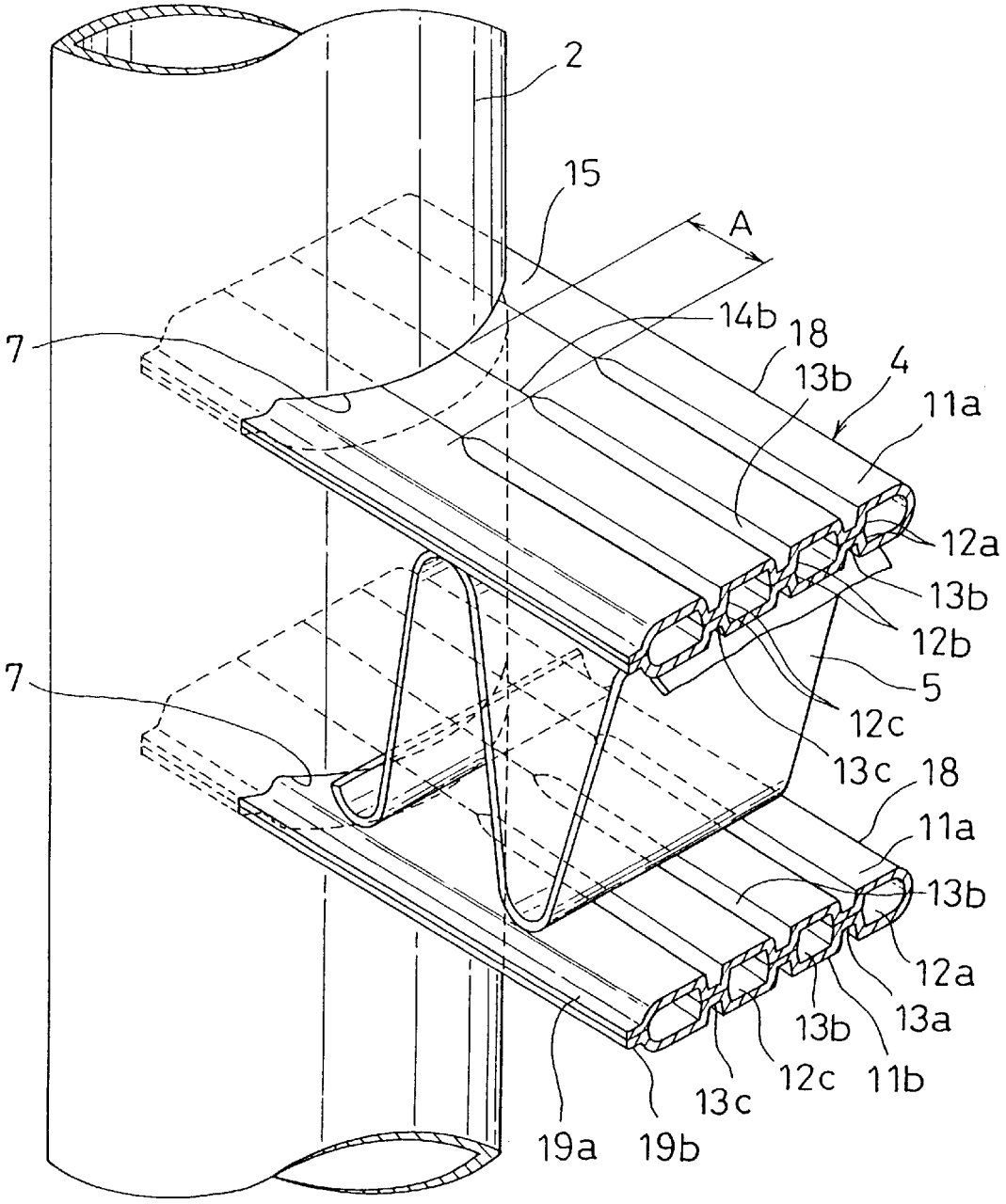

7
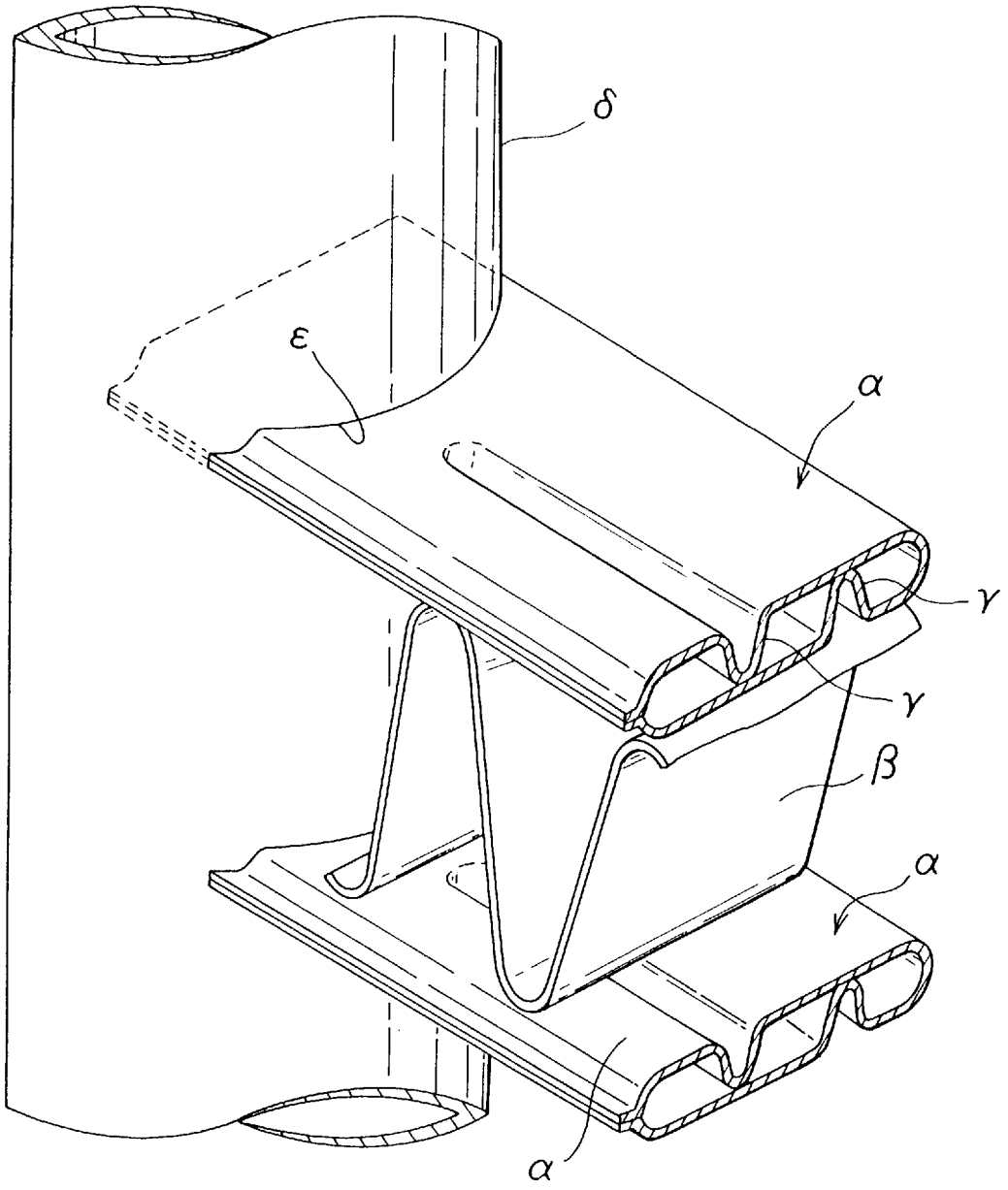

HEAT EXCHANGER

BACKGROUND OF THE INVENTION

1. Field of the Invention

The present invention relates to a heat exchanger that constitutes a portion of a cooling cycle, and in particular, it relates to a heat exchanger constituted by a pair of header pipes with a plurality of flat tubes communicating between the header pipes, and with the bonding of the header pipes and the flat tubes achieved by inserting and brazing the flat tubes at the header pipes.

2. Description of the Related Art

A heat exchanger constituted by a pair of header pipes with a plurality of flat tubes communicating between the header pipes is employed as a condenser or the like for cooling a high pressure coolant, and an example of such heat exchanger is disclosed in Japanese Unexamined Patent Publication No. H8-145591. In this heat exchanger, which is constituted by adopting a prerequisite bonding structure in which end portions of the flat tubes are inserted into tube insertion holes formed in the header pipes for brazing, a brazing margin similar to those at the side edges is formed at a middle area of each tube by dividing the end portions of the flat tube into separate portions, and the insertion holes of the header pipes are formed in a shape matching the shape of the end portions of the flat tubes to improve the brazing characteristics of the flat tubes themselves.

However, while the structure at the side edges is replicated at the middle area of each end portion according to the invention described above, based upon the observation that the brazing is achieved in a reliable manner at the aligned side portions of the flat tubes along their edges at the ends, it is also necessary to achieve good brazing for the flat tubes and the header pipes as well as to achieve good brazing for the flat tubes themselves. In particular, since the heat exchanging medium does not leak out of the tubes as long as good brazing is achieved at the side edges of the flat tubes, defective brazing at individual ridges within the flat tubes does not present a major problem. Rather, the brazing state between the header pipes and the flat tubes is a more critical concern, and if defective brazing occurs between the header pipes and the flat tubes, the heat exchanging medium may leak, and this will constitute a fatal defect in the heat exchanger. Consequently, priority should be given to eliminating any risk of defective brazing between the header pipes and the flat tubes.

Reviewing the prior art technology described above from this point of view, concerns arise in that forming the middle area of each end of a flat tube in an identical shape to that at the side edges and forming the insertion holes of the header pipes in a complicated shape to match this may reduce the degree of efficiency in the assembly work when a plurality of flat tubes are inserted at the insertion holes of the header pipes and in that, since the shape of the insertion holes is complicated, gaps between the header pipes and the flat tubes are more likely to be inconsistent, thereby reducing the yield of the brazing material.

Thus, it is desirable to form the end portions of the flat tubes to be inserted into the header pipes, and the tube insertion holes themselves, in as simple a shape as possible. Based upon this objective, the applicant of the present invention has previously proposed a bonding structure in which the end portions of the flat tubes are flattened and the tube insertion holes are also constituted of sides that are made as linear as possible in conformance to the shape of the flattened end portions to assure good brazing for the header pipes and the flat tubes.

As illustrated in FIG. 7, in this bonding structure, flat tubes $\alpha$ are each achieved by folding over a single brazing sheet to form a bend along the lengthwise direction with the two side edges facing opposite each other brazed to form heat exchanging medium passages, a ridge $\gamma$ is formed to extend along the lengthwise direction at a flat portion of the flat tube a that comes in contact with a fin $\beta$ and the ridge $\gamma$ is placed in contact with the inner surface of the flat portion on the opposite side to improve the pressure withstanding performance and the strength of the flat tube $\alpha$. In particular, the structure is characterized in that no ridge $\gamma$ is formed at the end portions of the flat tube $\alpha$ where it is to be inserted into insertion holes $\epsilon$ in header pipes $\delta$ and that the end portions of the flat tube $\alpha$ is formed flat with the insertion holes $\epsilon$ formed in a simple shape to match.

While good brazing is assured for the header pipes and the flat tubes in this structure, since no ridge is formed at the end portion of the flat tubes $\alpha$ to be inserted at the insertion holes $\epsilon$, it is necessary to reinforce these areas. In this case, if the ridge $\gamma$ is to be simply extended to be present at the end portion to achieve reinforcement, the shape of the insertion holes $\epsilon$ at the header pipes $\delta$ must be complicated to match the surface shape at the end portions of the flat tubes $\alpha$, as in the prior art technology explained above, which will tend to result in brazing defects between the header pipes $\delta$ and the flat tubes $\alpha$.

SUMMARY OF THE INVENTION

Accordingly, an object of the present invention is to provide a heat exchanger that achieves good brazing for header pipes and flat tubes while assuring a sufficient degree of strength at an end portion of each flat tube, to be inserted into an insertion hole, formed by machining a brazing sheet.

In particular, since it is crucial to achieve a good yield of the brazing material at the contact areas of the header pipes and the flat tubes in order to achieve a structure in which a ridge is formed and, at the same time, a high degree of flatness is assured at the end portions of the flat tubes, it is important that the heat exchanger be constituted by keeping this point in mind.

In order to achieve the object described above, the heat exchanger according to the present invention comprises a pair of header pipes, a plurality of flat tubes communicating between the pair of header pipes and fins provided between the individual flat tubes. The end portions of the flat tubes are inserted for brazing into insertion holes formed in the header pipes. Ridge located at the flat portions facing opposite each other to constitute each of the flat tubes and coming in contact with the inner surface of the other flat portion or ridges that project out from the inner surfaces of the two flat portions facing opposite each other and come in contact with each other, are formed along the lengthwise direction. The end portions of the flat tubes are flattened by setting the width of the grooves of the ridges formed at the surfaces of the flat portions so that it is at its smallest at the end portion each flat tube. Brazing is performed with end portions of the fins placed at the flattened portions formed at the end portions of the flat tubes.

Consequently, at the end portions of each flat tube, reinforcement is achieved with the ridges and a flattened surface is constituted with the grooves of the ridges formed at the surface of the flat portions eliminated, to achieve a simple shape for the insertion hole at the header pipe. This facilitates the insertion of the flat tubes, achieves a good yield of the brazing material by forming a consistent clearance between the insertion hole and the flat tube and, ultimately, makes it possible to achieve the object described above with ease. Now, in such a structure, in which flatness is achieved at the end portions of the flat tubes while still leaving the ridges at the end portions by setting its groove width at the smallest in this area, capillary-like creases are formed at the abutted areas of the groove walls, presenting a concern in that the brazing material present at the bonding areas of the header pipes and the flat tubes may flow through these creases during brazing, resulting in an insufficient quantity of brazing material remaining at the contact areas of the header pipes and the flat tubes, to induce defective brazing.

However, according to the present invention, since the end portions of the fins are placed in contact with the flattened portions formed at the end portions of the flat tubes for brazing, the brazing material that would flow through the creases can be blocked by the fins placed in contact with the abutted portions at the groove walls to prevent an excessive quantity of brazing material at the contact areas of the header pipe and the flat tubes from flowing out. Thus, it is desirable to set the contact areas for the fins as close as possible to the bonding positions where the header pipes and the flat tubes are bonded to each other. In addition, a fin may be placed in contact at two or more locations instead of at one location, as long as the contact portion of the fin can be placed in contact with the flattened portion.

In addition, the ridges that are formed at the flat portion may be provided continuously over the entire length of the flat tube, or a plurality of ridges may be provided intermittently, as long as such a configuration does not adversely affect the strength and the pressure withstanding performance. According to the present invention, the structure in which the portion where the groove width is set at a minimum is positioned at the contact areas of the header pipes and the tube elements is a prerequisite in the latter case as well.

In the flat tubes described above, the ridges formed at the flat portions facing opposite each other, are formed along the lengthwise direction of the flat tubes, and the width of the grooves formed by the ridges at the surfaces of the flat portions is set at a minimum at the end portions of the flat tubes to achieve flatness at the end portions of the flat tubes. Such a structure may be achieved through integrated formation by machining a brazing sheet.

The flat tubes may be achieved by folding over a single brazing sheet provided with ridges and bonding margins through press-machining or it may be constituted by forming ridges and bonding margins through press-machining at two brazing sheets and abutting the two brazing sheets. In addition, the ridges formed at the flattened portions at the end portions may achieve the smallest possible groove width by compressing the ridges during the formation of the ridges at the brazing sheet or may achieve the smallest possible groove width by compressing the ridges through a separate process implemented after forming ridges with a constant groove width.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings:

FIG. 1 is a front view illustrating the overall structure of a heat exchanger according to the present invention;

FIG. 2A is a plan view of a flat tube in the heat exchanger shown in FIG. 1, with FIG. 2B presenting an enlargement of the two end portions of the flat tube in FIG. 2A;

FIGS. 3A, 3B and 3C present cross sections and an end surface of the flat tubes in FIGS. 2A and 2B, with FIG. 3A presenting a cross section through line 3A—3A in FIG. 2B, FIG. 3B presenting a cross section through line 3B—3B in FIG. 2B and FIG. 3C presenting an end surface viewed from line 3C—3C in FIG. 2B;

FIG. 4 is a perspective showing a portion of the heat exchanger in FIG. 1 in an enlargement, illustrating a state in which end portions of the flat tubes are inserted at the insertion holes of a header pipe;

FIG. 5 illustrates an end portion of a flat tube in the heat exchanger inserted at an insertion hole of a header pipe, viewed from above, and viewed from a side;

FIG. 6 is a perspective view showing a portion of the heat exchanger according to the present invention employing another type of flat tubes in an enlargement; and FIG. 7 is a perspective view illustrating end portions of flat tubes in a heat exchanger inserted at insertion holes of a header pipe in a structure previously proposed by the applicant of the present invention.

DETAILED DESCRIPTION OF THE PREFERRED EMBODIMENTS

The following is an explanation of the embodiments of the present invention in reference to the drawings. In FIGS. 1 through 5, a heat exchanger 1, which is employed as, for instance, a condenser constituting a portion of the cooling cycle in an air conditioning system for vehicles, is provided with a pair of header pipes 2 and 3, a plurality of flat tubes 4 communicating between the pair of header pipes 2 and 3 and corrugated fins 5 that are inserted and bonded between the individual flat tubes 4. Under normal circumstances, the header pipes 2 and 3 are provided extending vertically, as illustrated in the figure, so that air flowing vertically relative to the surface of the drawing paper passes through between the fins 5.

The header pipes 2 and 3 are each constituted by forming an aluminum material clad with a brazing material into a cylindrical shape to constitute a header main body with the opening portions at the two ends of the header main body closed off by lid bodies 6 and a plurality of tube insertion holes 7 where the flat tubes 4 are inserted formed in alignment along the lengthwise direction. In this structural example, an intake portion 8 through which the heat exchanging medium flows in is formed at one of the header pipes, i.e., at the header pipe 2, and an outlet portion 9 through which the heat exchanging medium flows out is formed at the other header pipe 3. The header pipes 2 and 3 are formed through extrusion or by cutting a prefabricated pipe member into specific lengths. The inside of each of the header pipes 2 and 3 is partitioned by partitioning plates (not shown) into a plurality of flow passage chambers to form heat exchanging medium flow passages extending from the intake portion 8 to the outlet portion 9.

It is to be noted that reference number 10 indicates end plates provided at the two ends of the heat exchanging unit constituted of laminated flat tubes 4 and fins 5 in the direction of the lamination and fixed between the header pipes 2 and 3. In addition, the header pipes 2 and 3 may be each constituted of a cylindrical header main body achieved by abutting a gutter-like tube insertion plate having a plurality of tube insertion holes for inserting the flat tubes 4 and a separate gutter-like plate.

Thus, the coolant that has flowed in through the intake portion 8 enters the flow passage chamber at the upstream-most side of the header pipe 2, travels from this flow passage chamber through the flat tubes 4 to reach the header pipe 3, continues to flow between the header pipes through different flat tubes 4 and finally reaches the flow passage chamber at the downstream-most side of the header pipe 3 to flow out through the outlet portion 9. Consequently, the coolant that flows into the condenser 1, which is a high temperature, high pressure coolant that has been compressed at the compressor in the cooling cycle, discharges heat through heat exchange with the air passing between the fins 5 when it travels through the flat tubes 4 to become a low temperature, high pressure coolant.

The flat tubes 4 are each formed by press-machining an aluminum brazing sheet. More specifically, as illustrated in FIGS. 2 and 3, the entire brazing sheet is folded over by forming a bend 18 along the lengthwise direction, with ridges 12*a*, 12*b* and 12*c* formed along the lengthwise direction at flat portions 11*a* and 1*b* that face opposite each other. In addition, bonding margins 19*a* and 19*b* are formed at side edges of the flat portions 11*a* and 11*b* respectively, and by bonding these bonding margins 19*a* and 19*b* to each other, a heat exchanging medium passage is formed inside the flat tubes extending from one opening end to the other opening end.

The ridges are formed at both the flat portions 11*a* and 11*b*, with the ridge 12*b* formed at one of the flat portions, i.e., the flat portion 11*a*, and the ridges 12*a* and 12*c* formed at the other flat portion 11*b*, so that the ridges 12*a*–12*c* are offset from each other. In this structural example, the ridge 12*b* formed at the flat portion 11*a* is formed at one location at the center and the ridges 12*a* and 12*c* are formed at the other flat portion 11*b* at two locations offset from the center toward the two sides. Each of the ridges 12*a*, 12*b* and 12*c* is formed to project out from the flat portion where it is formed toward the other flat portion with its front end placed in contact with the inner surface of the other flat portion and brazed there. In this structural example, the heat exchanging medium passage within the flat tubes is divided into four separate branches whose flow passage areas are almost equal to each other by the three ridges 12*a*, 12*b* and 12*c*. Alternatively, the ridges may be formed so that they project out from the two flat portions facing opposite each other to come in contact with each other.

The ridges 12*a*, 12*b* and 12*c* are formed by press-machining a brazing sheet, having grooves 13*a*, 13*b* and 13*c* respectively with a specific width at the surfaces of the flat portions. The ridges themselves are pressed and compacted from the sides to abut the groove walls facing opposite each other so that the groove width of the grooves 13*a*, 13*b* and 13*c* constituted by forming the ridges is almost completely eliminated at the two end portions of each of the flat tubes 4, and the surfaces of the end portions of the flat tubes 4 are formed flat from the ends of the tube over a specific range except at creases 14*a*, 14*b* and 14*c* formed at the abutted portions where the groove walls are abutted. While flattened portions 15 of the flat tubes 4 are formed only in the areas that are inserted in insertion holes 7 of the header pipes 2 and 3 in this structural example, they may be formed at an area other than the two end portions of each of the flat tubes 4.

The insertion holes 7 for the flat tubes 4 are formed in conformance to the external shape of the flat tubes 4, and more specifically, as illustrated in FIG. 5, burring 16 is formed inward by press-machining the surface of the header pipe 2 from the outside so that the flat tubes 4 can be guided into the insertion holes 7 with ease. In addition, a crimp 17 is formed by pressing and compacting a corner of the opening end of the bend at the two ends of the flat tubes 4 to further facilitate the insertion of the flat tubes 4 into the insertion holes 7.

The flat tubes 4 are inserted into the header pipes 2 and 3 in such a manner that the crimps 17 do not extend to the insertion holes 7 and such that a part of each flattened portion 15 is left outside the header pipe over a specific length A. Thus, an end portion of a fin 5 comes in contact with the flat tube over the area corresponding to the length A to be brazed. The fin 5 comes in contact with the area A at its folded-back portion or at its end if the end of the fin is folded back, and is brazed at at least one position so that it crosses the creases 14*a*–14*c* formed at the flattened portion 15.

While it is desirable to place the fin in contact with both the upper and lower flattened portions of the flat tube, an end portion of the fin may be placed in contact with either the upper flattened portion or the lower flattened portion. Consequently, the length A is set in advance at a dimension that will allow the fin 5 to be placed in contact with the flattened portion 15 by taking into consideration the fin pitch and the shape of the end portion of the fin 5.

To achieve the structure described above, the heat exchanger 1 may be formed by providing prefabricated flat tubes 4, header pipes 2 and 3, fins 5 and the like, inserting the end portions of the flat tubes 4 into the insertion holes 7 of the header pipes 2 and 3, providing the fins 5 between the individual flat tubes 4, mounting the end plates 10 at the two ends in the direction of the lamination between the header pipes and securing the entire assembly in a jig for brazing in a furnace. Through the furnace brazing, the bonding margins 19*a* and 19*b* of the flat tubes 4 that are in contact with each other, the contact areas where the ridges 12*a*–12*c* come in contact with the inner surfaces, the contact areas where the flat tubes 4 and the fins 5 come in contact with each other and the like become brazed, and at the same time, the brazing material is distributed over the areas between the burrings 16 formed at the insertion holes 7 of the header pipes 2 and 3 and the flattened portions 15 of the flat tubes 4. Since the creases 14*a*–14*c* formed by abutting the groove walls are present at each flattened portion 15, the brazing material between the burrings 16 and the flattened portions 15 is guided by the creases 14*a*–14*c* through the phenomenon of capillary action to readily flow toward the positions where the groove width is larger. However, since the end portions of the fins 5 are placed in contact with the flattened portions 15, the brazing material flowing through the creases 14*a*–14*c* is blocked by the fins 5 to prevent an excessive quantity of the brazing material from flowing, thereby preventing defective brazing from occurring between the burrings 16 and the flattened portions 15.

It is to be noted that while a structure in which the flat tubes 4 are each formed by using a single brazing sheet is explained in reference to the example described above, the present invention may be adopted in a heat exchanger in which flat tubes 4 are each constituted by abutting two brazing sheets to achieve similar advantages. In addition, while the structure in which the ridges formed at the flat portions are placed in contact with the inner surfaces of the flat portions on the opposite side is explained in reference to the example given above, a structure in which ridges 12*a*, 12*b* and 12*c* project out from the inner surfaces of both of the two flat portions facing opposite each other are placed in contact with each other, as illustrated in FIG. 6, may be adopted instead. Furthermore, while the structure in which the ridges 12*a*–12*c* are formed over the entire length of the flat tubes 4 is explained in reference to the example given above, similar advantages may be achieved even in a structure with ridges formed intermittently by forming flattened portions by abutting the groove walls at the end portions of the flat tubes 4 to be inserted into the insertion holes 7 and bonding the end portions of fins at the flattened portions.

As has been explained, according to the present invention, since ridges are formed along the lengthwise direction at each of the two opposed flat portions of the flat tubes to come in contact with the inner surface of the other flat portion, the width of the grooves of the ridges formed surfaces of the flat portions is set so that it is at the smallest at the end portions of the flat tubes so that the end portions of the flat tubes comprise flattened surfaces and the end portions of the fins are placed at those flattened surfaces for brazing. In this manner, the strength can be increased even at the end portions of the flat tubes due to the presence of the ridges, and at the same time, the brazing material present between the header pipes and the flat tubes is blocked by the fins so that it will not flow through the abutted portions of the groove walls where the width is set at its smallest to assure a good yield of the brazing material at the bonding portions of the header pipes and the flat tubes and to prevent defective brazing.

In addition, by constituting each of the flat tubes from a brazing sheet, an improvement is also achieved in productivity. In addition, the machining of the end portions of the flat tubes that are to be inserted at the insertion holes into the header pipes is facilitated and any modification in machining in correspondence to the ridge shape and the fin pitch is also facilitated.

What is claimed is:

1. A heat exchanger comprising:

a pair of header pipes;

a plurality of flat tubes communicating between said header pipes;

fins provided between said flat tubes;

wherein each of said flat tubes has a pair of mutually facing flat portions;

wherein ridges are formed lengthwise along said flat portions of each of said flat tubes, each of said ridges projecting inwardly from one of said flat portions toward the other of said flat portions, so as to constitute grooves in outer surfaces of said flat portions facing outwardly of said flat portions and extending lengthwise along said flat portions;

wherein each of said flat tubes has flattened end portions, said grooves extend into said flattened end portions and widths of said grooves are at a minimum in said flattened end portions;

wherein insertion holes are formed in said header pipes;

wherein said flattened end portions of said flat tubes are inserted and brazed into said insertion holes, respectively;

wherein end portions of said fins are brazed in contact with said flattened portions of said flat tubes, respectively; and wherein said widths of said grooves are larger at areas other than said flattened end portions than at said flattened end portions.

2. A heat exchanger according to claim 1, wherein each of said flat tubes has first and second longitudinally extending sides and comprises a folded-over sheet having a fold portion constituting said first longitudinally extending side, said second longitudinally extending side being formed by two side edges of said sheet superimposed over one another and bonded together.

3. A heat exchanger according to claim 1, wherein burrings respectively project inwardly of said header pipes from circumferential edges of said insertion holes formed in said header pipes.

4. A heat exchanger according to claim 1, wherein ends of said flat tubes inserted into said insertion holes each have a corner portion with a reduced thickness at a folded portion.

5. A heat exchanger according to claim 1, wherein for each of said flat tubes, said ridges project inwardly from one of said flat portions so as to contact an inner surface of the other of said flat portions.

6. A heat exchanger according to claim 5, wherein for each of said flat tubes, said ridges are disposed to alternate, along a widthwise direction of said flat tube, between projecting inwardly from one of said flat surfaces and projecting inwardly from the other of said flat surfaces.

7. A heat exchanger according to claim 1, wherein for each of said flat tubes, each ridge projecting inwardly from one of said flat portions is in contact with a ridge projecting inwardly from the other of said flat portions.

8. A heat exchanger according to claim 1, wherein each of said flat tubes comprises a brazing sheet clad with a brazing material.

* * * * *